US011920359B2

(12) United States Patent
Duncan et al.

(10) Patent No.: US 11,920,359 B2
(45) Date of Patent: Mar. 5, 2024

(54) FRAMING BUDDY DECK FRAMING TOOL

(71) Applicants: William Stuart Duncan, Georgetown, SC (US); Beeman Burgoon, Georgetown, SC (US); James Anderson, Conway, SC (US)

(72) Inventors: William Stuart Duncan, Georgetown, SC (US); Beeman Burgoon, Georgetown, SC (US); James Anderson, Conway, SC (US)

( * ) Notice: Subject to any disclaimer, the term of this patent is extended or adjusted under 35 U.S.C. 154(b) by 393 days.

(21) Appl. No.: 17/394,852

(22) Filed: Aug. 5, 2021

(65) Prior Publication Data

US 2022/0049511 A1 Feb. 17, 2022

Related U.S. Application Data

(60) Provisional application No. 63/064,548, filed on Aug. 12, 2020.

(51) Int. Cl.
*E04G 21/18* (2006.01)
*E04B 1/00* (2006.01)

(52) U.S. Cl.
CPC ..... *E04G 21/1841* (2013.01); *E04B 1/003* (2013.01); *E04G 21/1891* (2013.01)

(58) Field of Classification Search
CPC .. E04G 21/1841; E04G 21/1891; E04B 1/003
USPC ..... 33/404, 416, 429, 526, 613, 645
See application file for complete search history.

(56) References Cited

U.S. PATENT DOCUMENTS 537,504 A 4/1895 Van Dorn
3,834,033 A * 9/1974 Pinkard ..... G01B 3/30 33/563
4,165,869 A 8/1979 Williams
4,264,063 A 4/1981 Halula
4,322,064 A * 3/1982 Jarvis ..... E04G 21/1891 269/910
4,340,100 A 7/1982 Anderson, II
5,054,755 A 10/1991 Hawkes
5,190,268 A * 3/1993 Espinueva ..... E04H 17/1417 256/65.01
5,746,421 A 5/1998 Bowerman
5,822,942 A * 10/1998 Lucia, Jr. ..... E04G 23/02 33/645
6,126,156 A 10/2000 Brodeur
6,301,855 B1 10/2001 Aerni
6,513,286 B2 2/2003 Vierra
8,176,648 B2 * 5/2012 Bradley ..... E04G 21/1883 33/562
8,601,705 B2 * 12/2013 Bierman ..... G01B 3/30 33/613
9,435,130 B2 * 9/2016 Briganti ..... B25H 7/04
9,809,974 B1 * 11/2017 Brekke ..... E04B 1/388
(Continued)

*Primary Examiner* — George B Bennett
(74) *Attorney, Agent, or Firm* — Carlson, Gaskey & Olds, P.C.

(57) ABSTRACT

A framing tool supports one end of beam member while the other end of the beam is secured to another beam or structure. The framing tool includes a support portion, a receiving portion and a strap. The strap wraps around a beam member to secure the beam member within the receiving portion. The support portion holds one end of the beam member in place so that an installer may secure the other end of the beam member without the aid of another installer.

20 Claims, 5 Drawing Sheets

(56) References Cited

U.S. PATENT DOCUMENTS

| | | | | |
|---|---|---|---|---|
| 11,668,552 | B1 * | 6/2023 | Braddock | B25H 7/02 33/429 |
| 2007/0193193 | A1 | 8/2007 | Lewis | |
| 2018/0334817 | A1 * | 11/2018 | Chahine | E04G 21/1891 |
| 2021/0180349 | A1 * | 6/2021 | Dandurand | E04G 21/1891 |
| 2023/0219362 | A1 * | 7/2023 | Skillicorn | G01B 3/566 33/197 |

* cited by examiner

FRAMING BUDDY DECK FRAMING TOOL

CROSS REFERENCE TO RELATED APPLICATION

This application claims priority to U.S. Provisional Application Ser. No. 63/064,548 filed on Aug. 12, 2020.

TECHNICAL FIELD

The present disclosure relates to tool for aiding assembly of joists.

BACKGROUND

Traditional framing of decks and homes utilizes joist that extend between transversely arranged rim joists. The joists are attached with hangers to hold the joists such that they align with a top surface of a rim joist. Assembly typically requires one worker to hold one side of a joist while another worker supports and attaches the other side of the joist. Accordingly, assembly requires two workers, one to hold and one to perform the attachment. One worker is therefore not efficiently utilized. Moreover, a single person is substantially prevented from effectively building their own deck.

The background description provided herein is for the purpose of generally presenting a context of this disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A framing tool according to an exemplary embodiment of this disclosure, among other possible things includes a support portion, a receiving portion and a strap. The strap wraps around a beam member to secure the beam member within the receiving portion. The support portion holds the end of the beam member secured within the receiving portion in place so that an installer is free to hold and secure the other end of the beam member without the aid of another installer.

A method of holding beam members for securement according to another example embodiment includes the step of placing a receiving portion of a disclosed example framing tool onto a first end of a first beam member. The framing tool is secured by wrapping a strap around the first member. A support portion of the framing tool holds a first end of the first beam in place while a second end of the first beam is attached and fixed to another beam.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
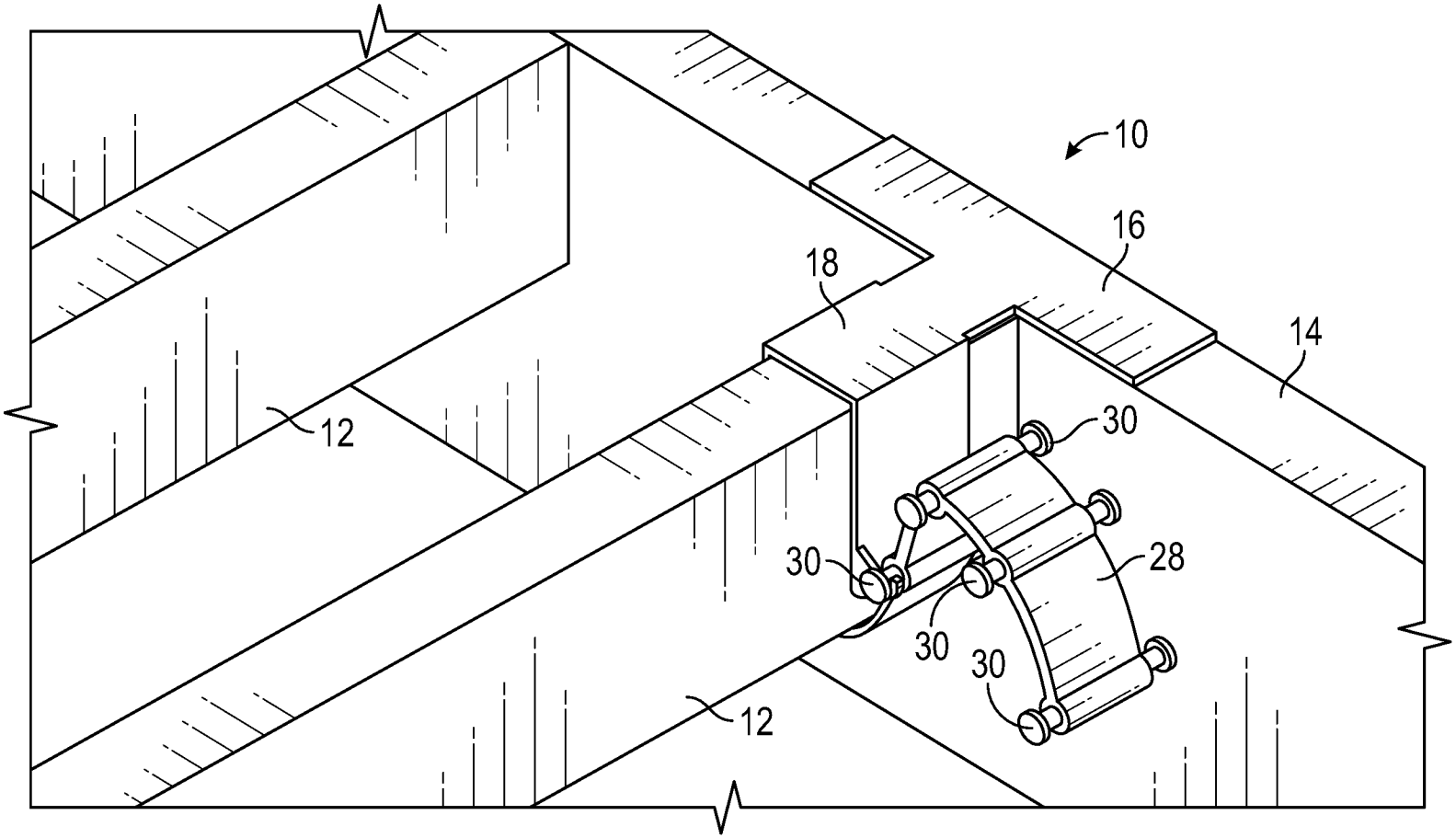
FIG. 1 is a perspective view of an example framing tool supporting a joist.
Figure 2:
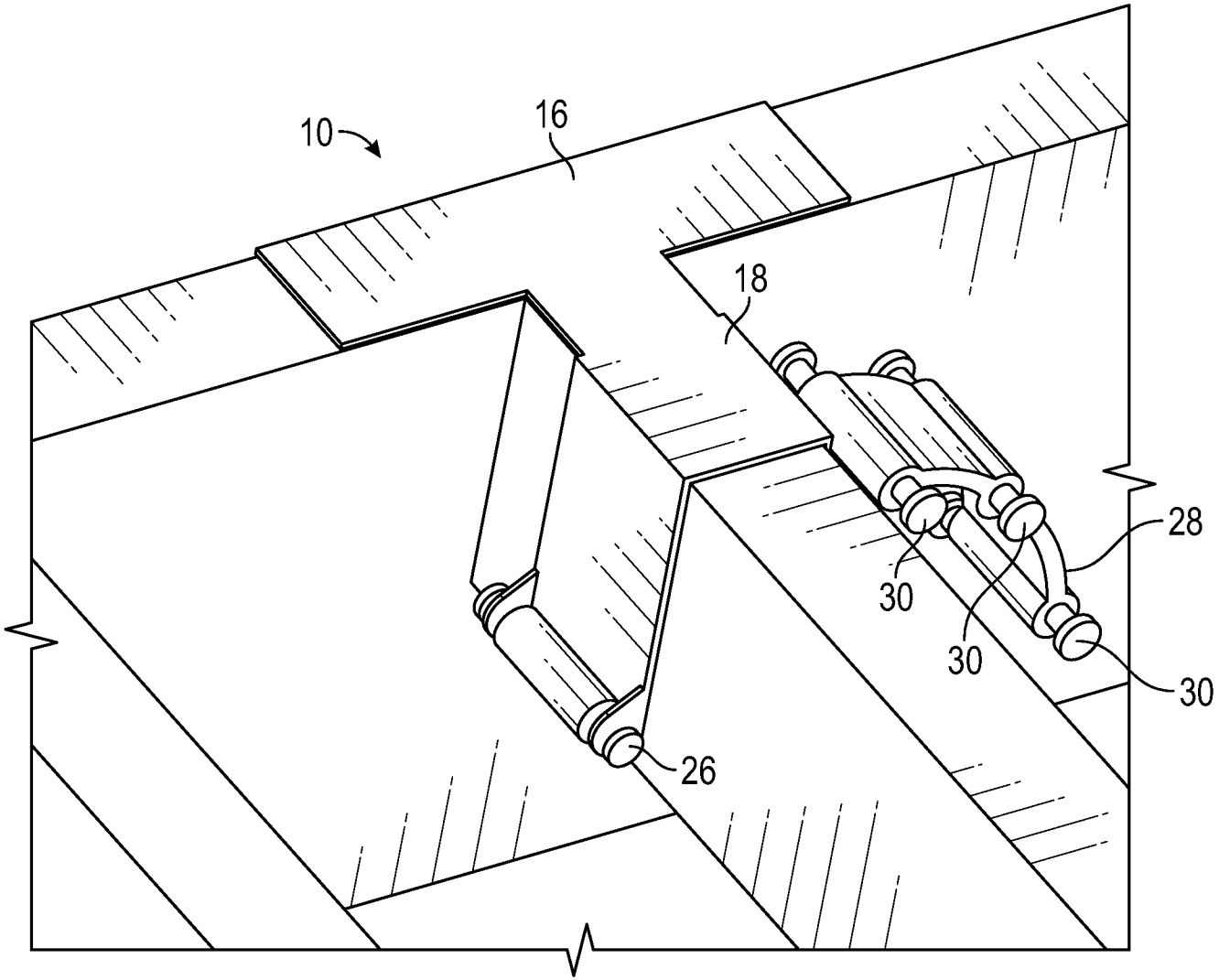
FIG. 2 is another perspective view of the example framing tool supporting a joist.

Referring to FIGS. 1 and 2, a framing tool 10 is shown supporting and aligning one end of a joist 12 on a rim joist 14. The other end of the joist 12 may than be attached to a corresponding support member without the need to have an assistant. The framing tool 10 includes a single integral part with a support potion 16 and a receiver portion 18. A strap 28 is attached to the receiver portion 18 and includes metal pins 30. The strap 28 wraps around a bottom of the joist 12 such that one of the metal pins 30 is held in a catch 32. The strap 28 holds the joist 12 within the receiver portion 18. The support portion 16 holds a top surface of the joist 12 in alignment with a top surface of the rim joist 14. It should be appreciated, that the term Joist as used in this disclosure is by way of example and that the framing tool 10 could be utilized with other frame members within the scope and contemplation of this disclosure.

Assembly of a joist 12 to a rim joist 14 is therefore performed by attaching the framing tool 10 to one end of the joist 12. The support portion 16 is supported on the top surface of the rim joist 14. The opposite end of the joist 12 may be aligned and attached to another joist or other structural member because the framing tool 10 holds the unattached end in a desired alignment. The end supported by the framing tool 10 can then be attached and the framing tool 10 removed for use on the next joist. It should be appreciated that although a joist 12 and rim joist 14 are disclosed by way of example that it is within the contemplation and scope of this disclosure that the framing tool 10 could be utilized in attachment of other beam members.

Figure 3:
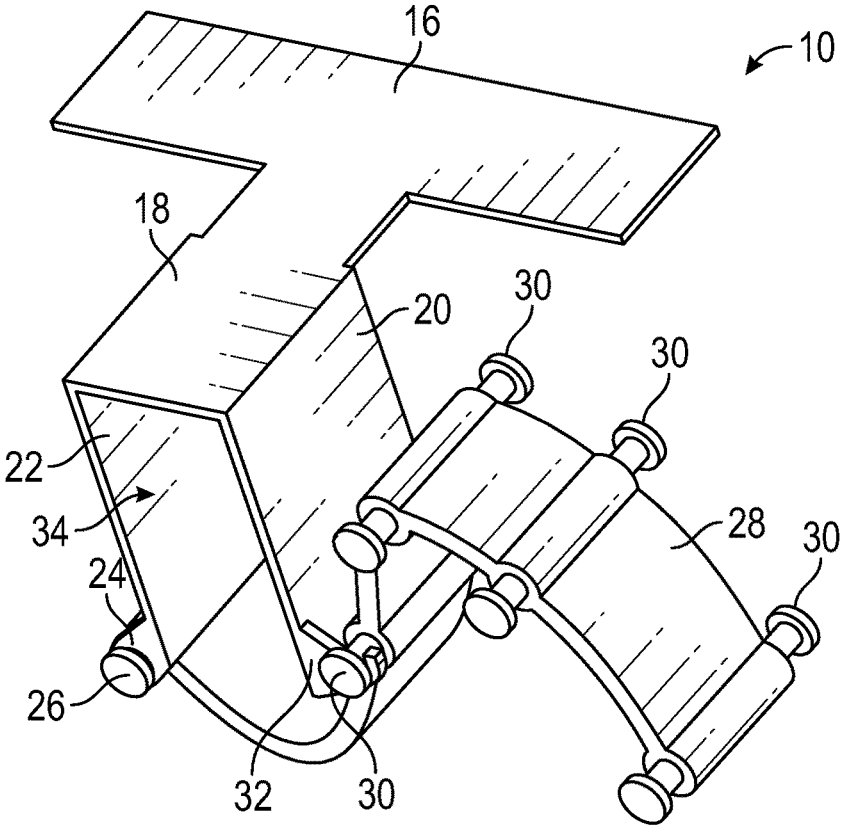
FIG. 3 is a perspective view of the example framing tool.
Figure 4:
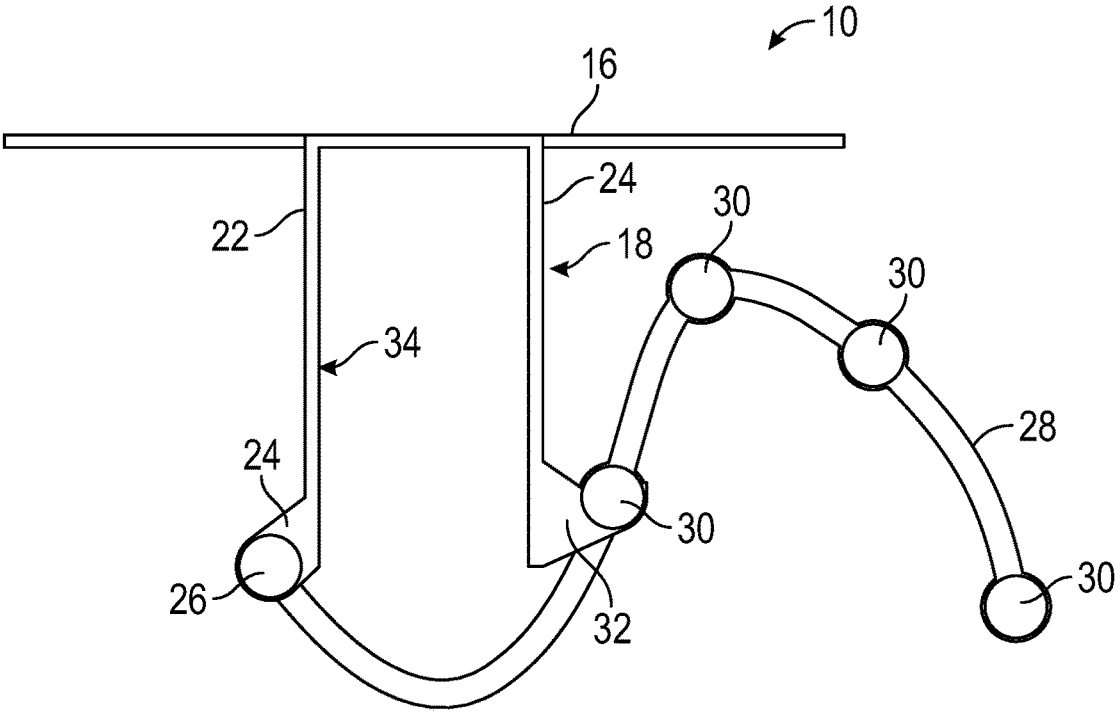
FIG. 4 is a rear view of the example framing tool.

Referring to FIGS. 3 and 4 with continued reference to FIGS. 1 and 2, the receiver portion 18 includes a first arm 20 and a second arm 22 that defines a space 34 therebetween. The space 34 is of a width that corresponds with a thickness of the joist 12. The length of the first arm 20 and the second arm 22 is equal to or less than the smallest size joist supportable by the framing tool 10. A joist is received within the space 34 and held in place by the strap 28. The width of the space 34 may be two inches, four inches or any other width that corresponds with common lumber dimensions. Moreover, although the example space 34 is fixed, the space may be adjustable to enable adaptation to lumber and beam members of different dimensions.

Securement is provided by pulling the strap 28 around the joist and placing the appropriate metal pin 30 into the catch 32. In this example the catch 32 incudes a first catch portion 32A and a second catch portion 32B (See FIG. 6) disposed on either side of the arm 20. In this example, the catch 32 is disposed on the first arm 20. The strap 28 is formed from resilient material with some ability to stretch to provide tight securement around the joist 12. In one disclosed example, the strap 28 is formed from a woven elastic material.

The strap 28 is secured by a holder pin 26 secured within a holder portion 24 on the first arm 22. The holder portion 24 are flanges that extend from the arm 22 and include openings for the holder pin 26. The strap 28 includes several metal pins 20 that are molded into the strap 28 or received in pockets formed in the strap 28. The metal pins 20 are spaced apart at specific intervals that correspond to common sizes of joists 12. For Example, the metal pin 30 nearest the holder pin 26 is for a 2"×4" joist. The second pin 30 is for a 2"×6" joist. A third pin 30 is for a 2"×8" joist and the last pin 30 spaced apart to work with a 2"×10" joist. Of course, additional sizes could be provided for by elongating the strap 28 and properly spacing the position of the metal pins 30.

Figure 5:
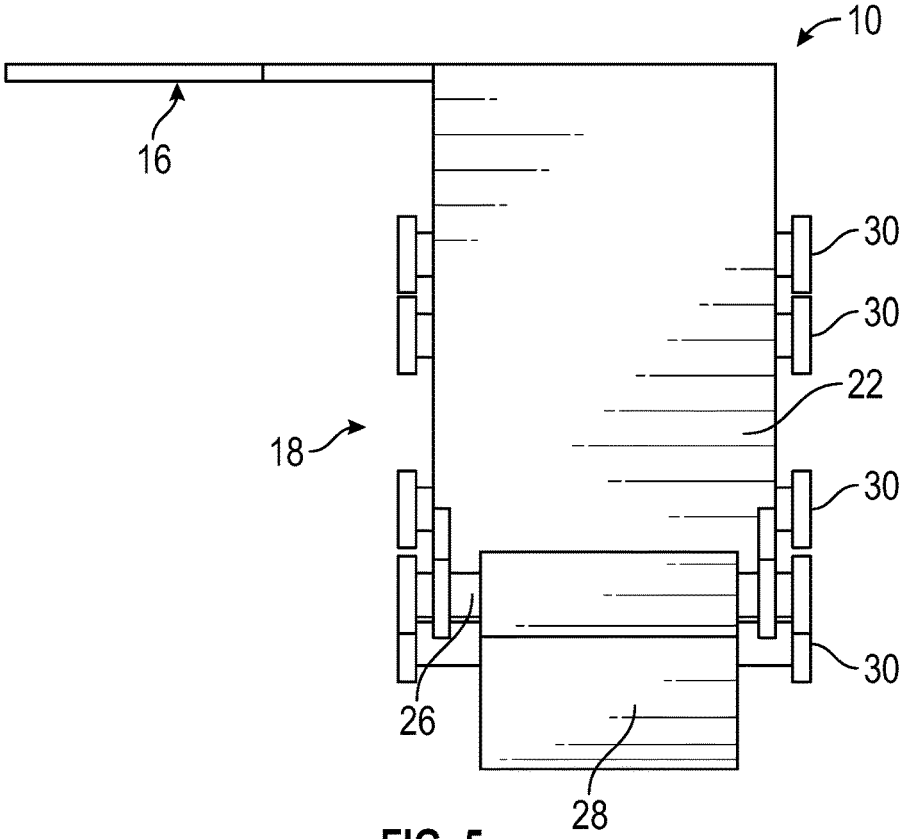
FIG. 5 is a side view of a first side of the example framing tool.
Figure 6:
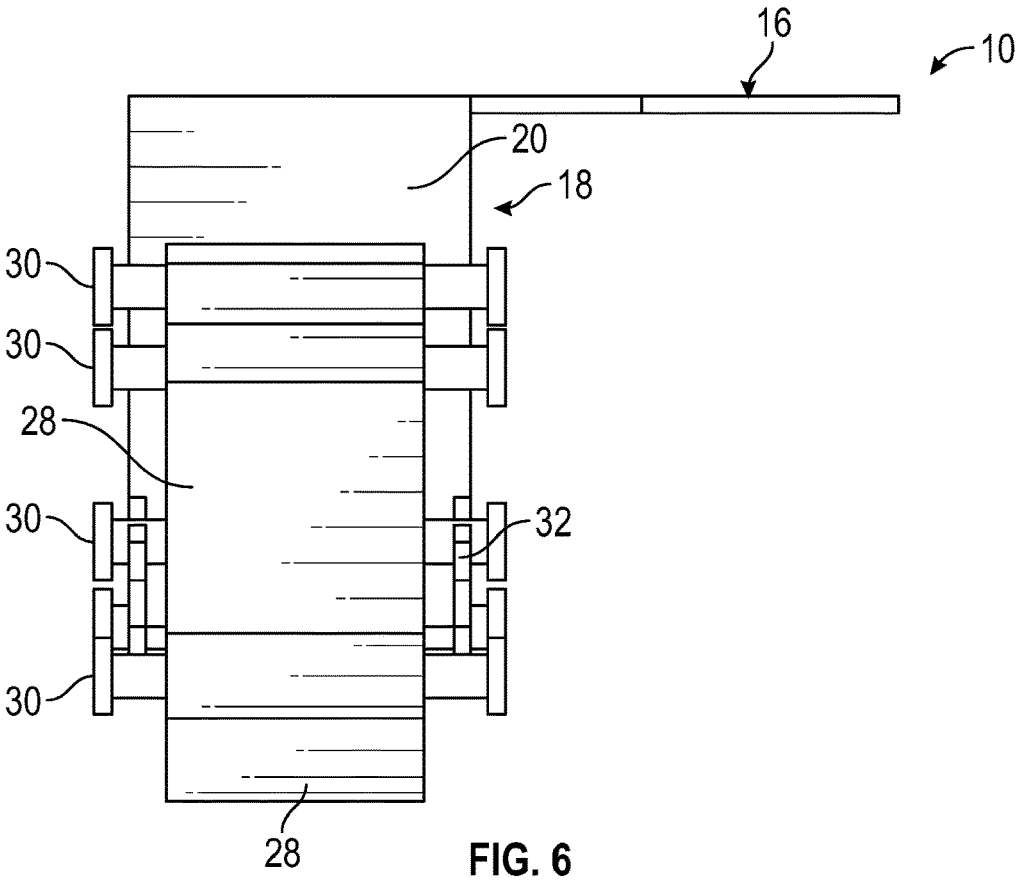
FIG. 6 is a side view of a second side of the example framing tool.

Referring to FIGS. 5 and 6 with continued reference to FIGS. 3 and 4, the framing tool 10 is formed from metal material that is joined together to provide the support portion 16 and the receiving portion 18. The support portion 16 is formed as a substantially rectangular plate that sits on a top surface of a rim joist 14. The length of the rectangular plate is provided to maintain stability of the captured joist 12. In one disclosed example, the support portion 16 is at least three times the width of the space between the arms 20, 22 of the receiving portion. As appreciated, a worker on the other end of the joist 12 will use the stability provided by the support portion to maintain proper alignment. The support portion 16 may be of different lengths and widths to provide the desired stability and alignment.

The receiving portion 18 is spaced part from the support portion, as particularly, the rectangular part. The spaced apart configuration prevents interference with alignment and also provides support for installation of joist hangers. Accordingly, a joist hanger can be assembled to the rim joist 14 with the joist 12 supported by the framing tool 10 if desired.

The receiving portion 18 includes the downward extending first arm 20 and second arm 22 that are disposed on either side of the joist 12. The spacing 34 between the arms 20, 22 provides a snug fit that is not so tight as to be difficult to install, but not so loose as to not maintain alignment. Moreover, the fit accommodates variations in lumber.

In this example, the support portion 16 and the receiver portion 18 are formed from a powder coated metal material. The metal materials can be separate parts welded together or cut sheet material that is bent to shape. As appreciated, other materials such as plastic materials, could be utilized and are within the contemplation of this disclosure.

Figure 7:
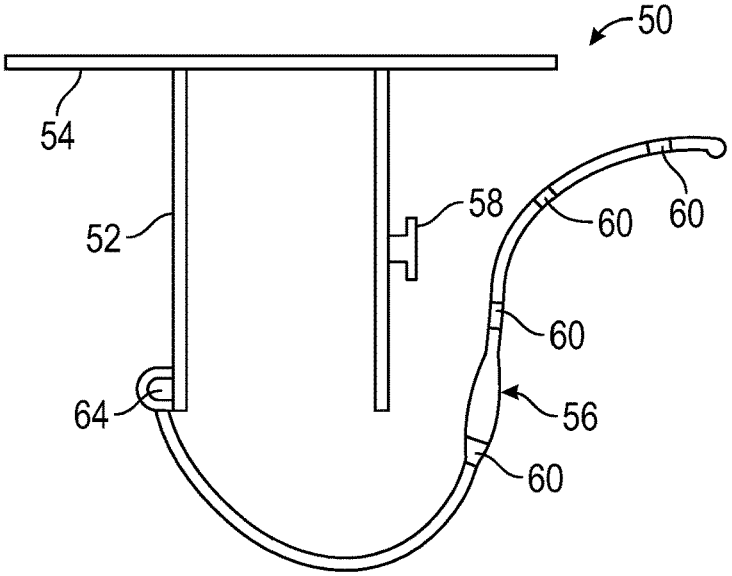
FIG. 7 is a front view of another example framing tool embodiment.
Figure 8:
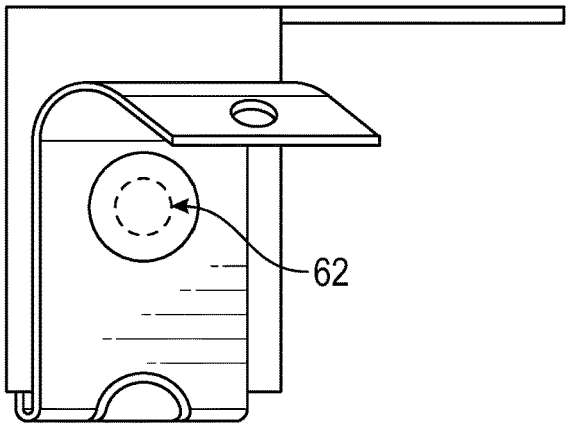
FIG. 8 is a side view of the example framing tool embodiment shown in FIG. 7.
Figure 9:
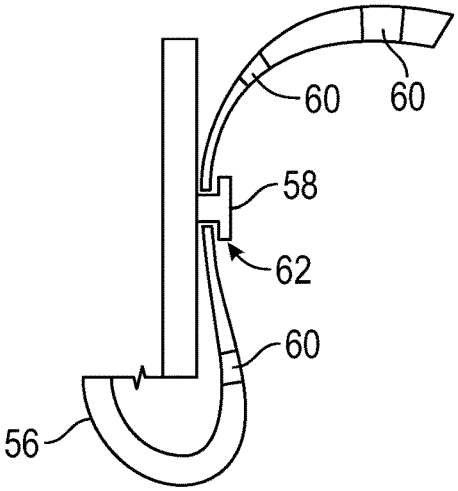
FIG. 9 is an enlarged view of a portion of the example framing tool.

Referring to FIGS. 7, 8 and 9, another example framing tool embodiment is shown and indicated at 50. The framing tool 50 includes a support portion 54 and a receiver portion 52 configured in the same manner as the previously described embodiment. The receiver portion 52 includes a boss 58 with a flange portion 62. A strap 56 is secured to one side of the receiver portion 52 by a pin 64. The strap 56 includes a plurality or spaced apart openings 60. The openings 60 are sized to fit onto the boss 58. The strap 56 is formed from an elastic material with limited amount of stretch to provide for assembly over the flange 62 to rest on the boss 58. The spacing between the openings 60 corresponds with differently sized beam members that are received within the receiver portion.

A boss 58 and flange 62 is disclosed by way of example in the example framing tool embodiment 50, however, a hook or other configuration onto which the strap 56 could be fit could also be utilized and are within the contemplation and scope of this disclosure.

Accordingly, the example disclosed framing tool embodiments provide for holding of joists and other beam members that aid assembly of deck and other structures.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A framing tool comprising:

a support portion;

a receiving portion configured for receiving a beam member; and a strap attachable to the receiving portion configured for holding a beam member within the receiving portion.

2. The framing tool as recited in claim 1, wherein the receiving portion includes a catch and the strap includes at least one pin, wherein the catch is configured to hold the at least one pin and thereby the strap around the beam member.

3. The framing tool as recited in claim 2, wherein the at least one pin is of a length that is greater than a width of the strap.

4. The framing tool as recited in claim 3, wherein the at least one pin includes a flange portion at each end.

5. The framing tool as recited in claim 2, wherein the at least one pin comprises a plurality of pins that are spaced apart along the strap.

6. The framing tool as recited in claim 5, wherein each of the plurality of pins are spaced apart from each other along a length of the strap at locations corresponding to predefined beam member widths.

7. The framing tool as recited in claim 2, wherein the strap includes a holding pin secured to an end portion of the strap, the holding pin holding the end portion to the strap to the receiving portion.

8. The framing tool as recited in claim 7, wherein the holding pin is inserted through an opening defined in the end portion off the strap.

9. The framing tool as recited in claim 1, wherein the receiving portion comprises first and second arms that are spaced apart to receive a beam member therebetween.

10. The framing tool as recited in claim 1, wherein the strap comprises an elastic member.

11. The framing tool as recited in claim 1, wherein the strap comprises a webbing material.

12. The framing tool as recited in claim 1, wherein the support portion includes a width that is greater than a width of the receiving portion.

13. The framing tool as recited in claim 1, wherein the support portion includes a first end and a second end that extend transversely relative to the receiving portion.

14. The framing tool as recited in claim 1, wherein the support portion and receiving portion comprises a single integral part.

15. The framing tool as recited in claim 1, including at least one securement structure disposed on the strap that is configured for holding the strap to the receiving portion.

16. The framing tool as recited in claim 15, wherein the at least one securement structure is an integral portion of the strap.

17. The framing tool as recited in claim 1, wherein the strap includes a plurality of openings that are spaced apart along the strap and the receiving portion includes a boss, wherein the boss is configured to be inserted through one of the plurality of openings to hold the strap around the beam member.

18. A method of holding beam members for securement comprising:

placing a receiving portion of an assembly tool onto a first beam member;

securing the assembly tool to the first beam member with a strap wrapped around the first beam member; and placing a support portion of the assembly tool onto a second beam member to orientate the first beam member relative to the second beam member.

19. The method as recited in claim 18, wherein securing the assembly tool to the first beam member comprises placing one of a plurality of securement structures disposed on the strap into a catch disposed on the receiving portion.

20. The method as recited in claim 18, wherein the strap includes a plurality of securement structures spaced apart along the strap and securing the assembly tool to the first beam member comprises selecting one of the plurality of securement structures corresponding to a width of the first beam member into a catch.

* * * * *